US005871384A

United States Patent [19]

Kichijo

[11] Patent Number: 5,871,384

[45] Date of Patent: Feb. 16, 1999

[54] BLOCK ASSEMBLY AND DEVICES FORMED THEREBY

[76] Inventor: Hiroshi Kichijo, 1563, Koshibe, Oyodo-cho, Yoshino-gun, Nara, Japan

[21] Appl. No.: 433,106

[22] Filed: May 3, 1995

Related U.S. Application Data

[63] Continuation-in-part of Ser. No. 229,775, Apr. 19, 1994, Pat. No. 5,482,491.

[51] Int. Cl.[6] ..... A63H 33/08

[52] U.S. Cl. ..... 446/112; 446/120

[58] Field of Search ..... 446/111, 112, 446/113, 115, 116, 120, 124, 125, 121, 108; 52/285.1, 285.3, 282.2, 284, 582.1, 584.1, 585.1, 586.1; D21/108; 428/53, 57, 60, 44, 33

[56] References Cited

U.S. PATENT DOCUMENTS

| | | | |
|---|---|---|---|
| 2,794,293 | 6/1957 | Milrod et al. | 446/112 |
| 3,032,919 | 5/1962 | Amsler | 446/112 |
| 3,528,559 | 9/1970 | Miller | 52/285.3 X |
| 3,827,177 | 8/1974 | Wengel | 446/112 |
| 4,305,221 | 12/1981 | Chatani | 446/121 |
| 4,345,762 | 8/1982 | Lebelson | 446/127 X |
| 4,548,590 | 10/1985 | Green | 446/125 X |
| 5,061,219 | 10/1991 | Glickman | 446/120 X |

FOREIGN PATENT DOCUMENTS

| | | | |
|---|---|---|---|
| 2596824 | 10/1987 | France | 446/125 |
| 2251951 | 11/1973 | Germany | 446/124 |

*Primary Examiner*—Mickey Yu
*Attorney, Agent, or Firm*—Joseph C. Mason, Jr.; Louise A. Foutch

[57] ABSTRACT

The present invention relates to a block assembly including plane blocks and joint blocks made from a specified synthetic resin which is readily assembled into any shape such as a plane body or a solid body with a close resemblance to a model body and also readily decomposed, and a decoration prepared by impregnation of the block assembly with a specified solvent for the necessary time for solidification.

21 Claims, 15 Drawing Sheets

BLOCK ASSEMBLY AND DEVICES FORMED THEREBY

This application is a continuation-in-part of Ser. No. 229,775 filed Apr. 19, 1994, now U.S. Pat. No. 5,482,491.

BACKGROUND OF THE INVENTION

1. Field of the Invention

This invention relates to a block assembly and devices made from the block assembly, and more particularly to a block assembly providing plane blocks with coupling concave (recessed) portions and joint blocks with coupling convex (protruding) portions which are successively coupled to each other to assemble not only a planar body but also a three-dimensional solid body, and devices such as a chandelier or an ornament prepared from the block assembly.

2. Description of the Prior Art

There are many toys that include building blocks for making an unlimited number of items. Some of the toys merely provide toy bricks that are secured together to form various objects. Toys of the brick type cannot provide numerous shapes and devices, however, due to the limitations imposed by the building blocks and the fact that such building blocks can only be connected to one another in limited ways.

Erector sets offer more flexibility then do brick-based toys, but they are also subject to limitations because screws and nuts are required to join together the toy beams and girders that serve as the building blocks. Moreover, such toys have connections limited to only a few degrees of freedom; this restricts the variety of objects that can be made therefrom.

Still other toys, such as the well-known "LEGGO" (trademark) toy, are free of screws and nuts but offer limited degrees of freedom in constructing various articles or devices. Moreover, the "snap"-type connectors provided therewith provide a relatively weak interconnection.

Another common shortcoming of the known devices is that any article or device made therefrom is forever an assembled device, i.e., there are no suitable means for converting such article into a permanent device or work of art.

What is needed, then, is a construction toy having building blocks with unique coupling means to increase the number of degrees of freedom available to the user thereof. A need also exists for a means whereby completed articles made of up individual building blocks could be converted into a permanent one piece device.

However, in view of the prior art at the time the present invention was made, it was not obvious to those of ordinary skill in this art how such a device could be provided.

SUMMARY OF THE INVENTION

The longstanding but heretofore unfulfilled need for a building block toy having increased degrees of freedom, improved interconnecting means, and means for preserving articles made thereby is now met by a system that provides two basic building blocks of unique configuration and structural qualities.

The first basic building block is called hereinafter a "plane" block and the second type of block is referred to hereinafter as a "joint" block. Joint blocks have protruding coupling means and plane blocks have recesses formed therein to receive said protruding coupling means.

More particularly, each plane block has formed therein at least one coupling recess in the form of a slot-like recess disposed along the center of at least one side thereof.

Each joint block includes at least one coupling protrusion projecting outwardly from at least one side thereof. A pincer-like pair of pinch members are formed in the tip of each coupling protrusion; said pinch members are adapted to frictionally grasp a coupling recess formed in a plane block.

The building blocks are preferably formed of a synthetic resin selected from the group of resins including acrylic resin, styrene resin, ABS resin, or other suitable resin. After an article has been constructed by assembling together the building blocks in a preselected pattern, the article is preserved by immersing it for a preselected time in a bath of methyl ethyl ketone, toluene, or other suitable solvent. The solvent "melts" the resin and seals the interstitial spaces between the structural parts of the article. The resulting one piece article is removed from the bath and used as desired.

It is therefore understood that an important object of this invention is to advance the art of building block-related toys.

Another object is to provide a means whereby the toys made of building blocks may be preserved as integral devices.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

FIG. 1 through FIG. 45 show Embodiment 1 through Embodiment 3 and alternative Embodiment 1 through alternative Embodiment 3 of blocks for assembly and block assemblies relating to the present invention, and a method for preparing a decoration by the present block assemblies.

Figure 15:
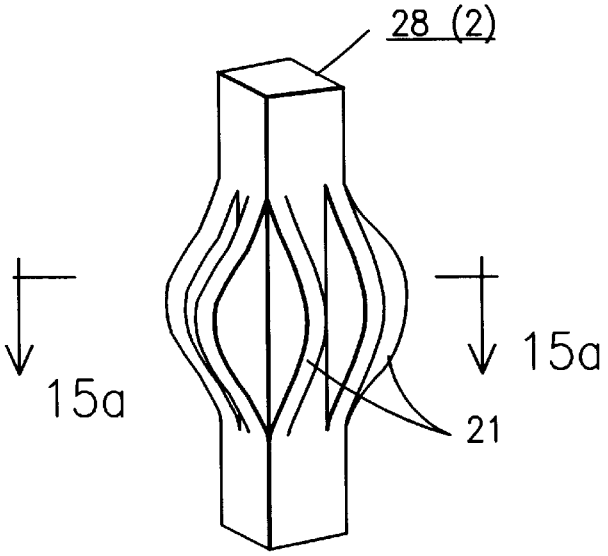
FIG. 15 is a perspective view and a sectional view taken along line showing one example of a joint block in Embodiment 1.
Figure 15A:
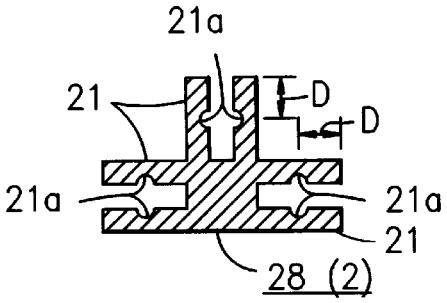
Figure 16:
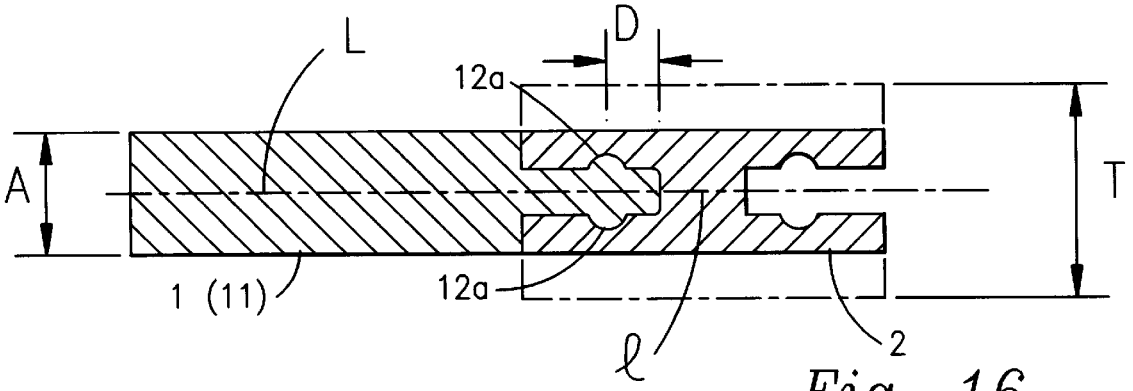
FIG. 16 is a sectional view of alternative Embodiment 1.
Figure 25:
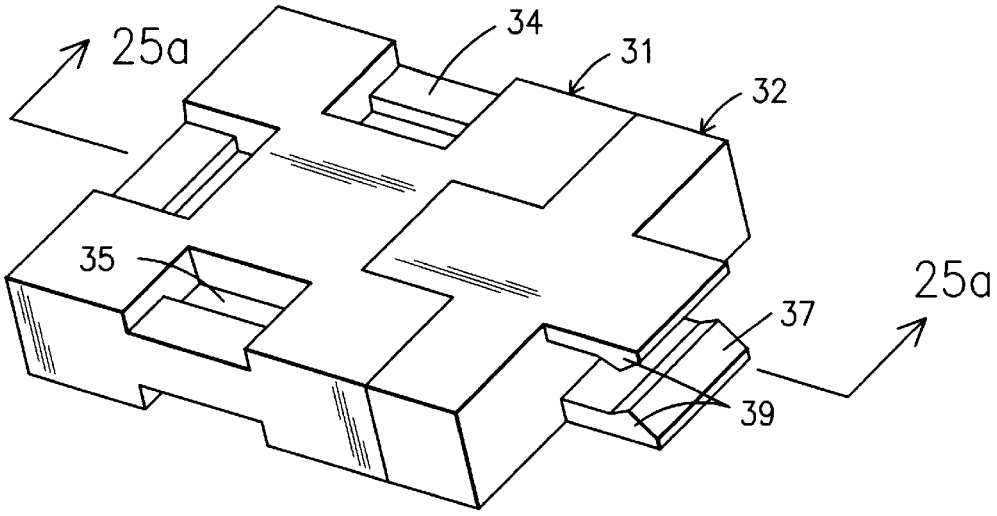
FIG. 25 is a perspective view and a sectional view taken along line showing a plane block and a joint block coupled together in Embodiment 2.
Figure 25A:
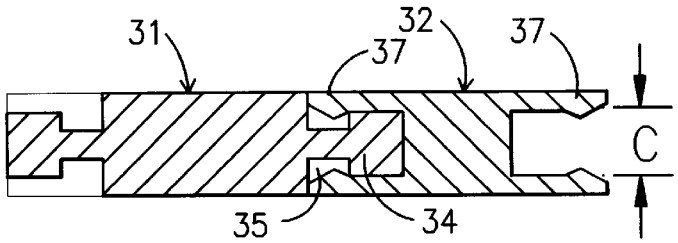
Figure 26:
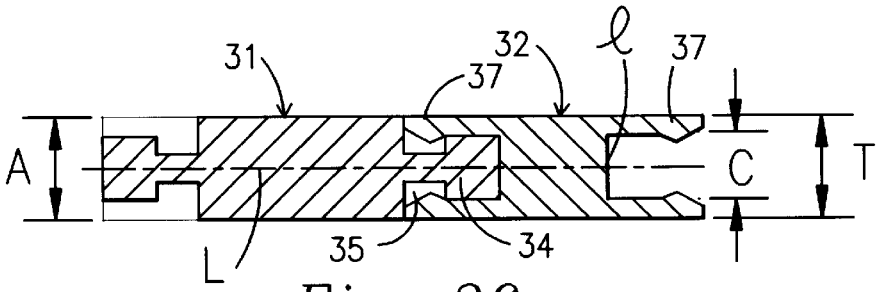
FIG. 26 is a sectional view of alternative Embodiment 2.
Figure 36:
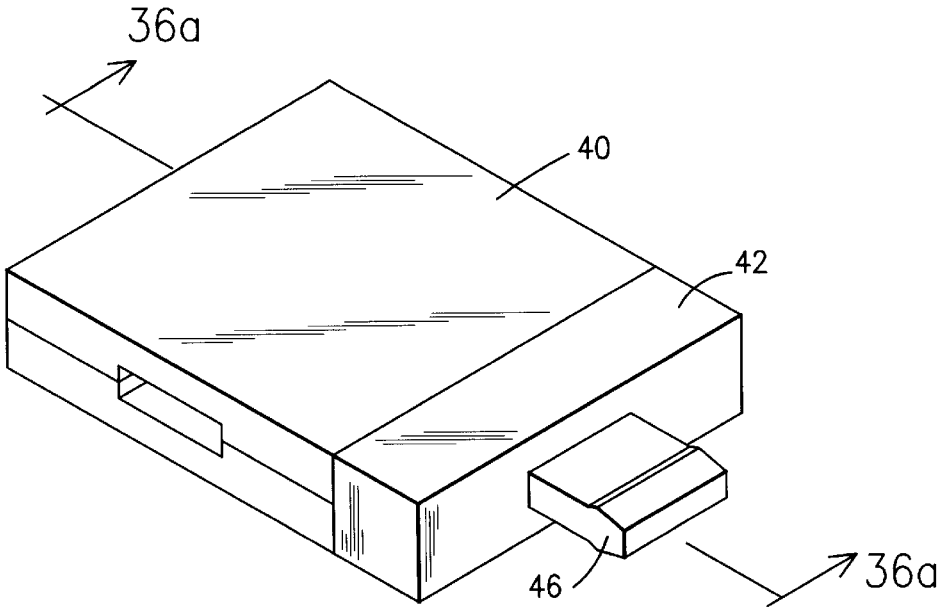
FIG. 36 is a perspective view and a sectional view taken along line showing a square plane block and a joint block coupled together in Embodiment 3.
Figure 36A:
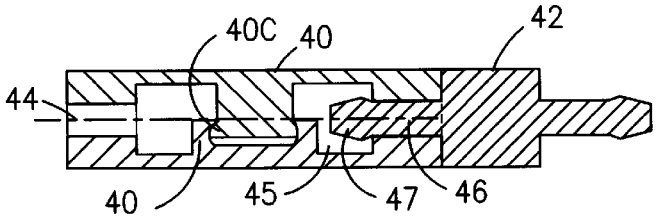
Figure 37:
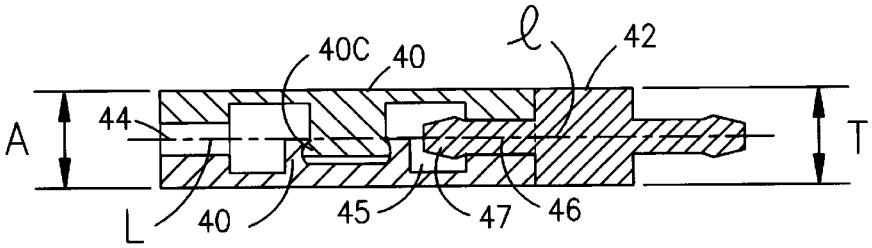
FIG. 37 is a sectional view of alternative Embodiment 3.
Figure 45:
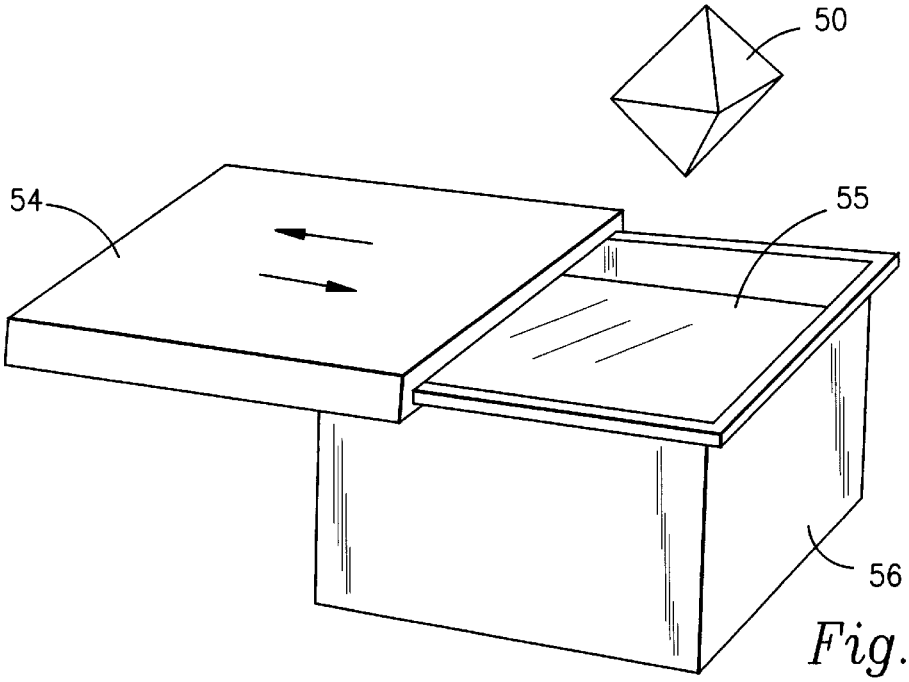
FIG. 45 is a perspective view for explaining how to prepare a decoration.

FIG. 1 through FIG. 15 show Embodiment 1 of the block assembly; FIG. 16 shows alternative Embodiment 1; FIG. 17 through FIG. 25 show Embodiment 2 of the block assembly; FIG. 26 shows alternative Embodiment 2; FIG. 27 through FIG. 36 show Embodiment 3 of the block assembly; FIG. 37 shows alternative Embodiment 3; FIG. 38 through FIG. 44 show finished block assemblies; and FIG. 45 shows an explanatory drawing of a method for preparing a decoration relating to the present invention.

FIG. 1 through FIG. 4 show plane block 1 used in Embodiment 1; FIG. 5 thorough FIG. 15 show joint block 2 used in Embodiment 1.

FIG. 16 shows an explanatory view of alternative Embodiment 1.

Figure 17:
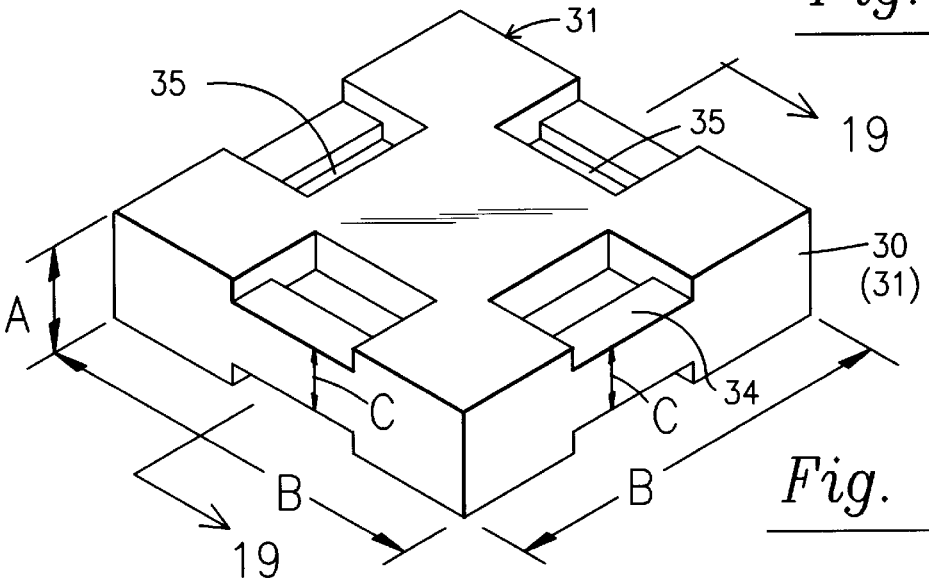
FIG. 17 is a perspective view showing one example of a square plane block in Embodiment 2.
Figure 18:
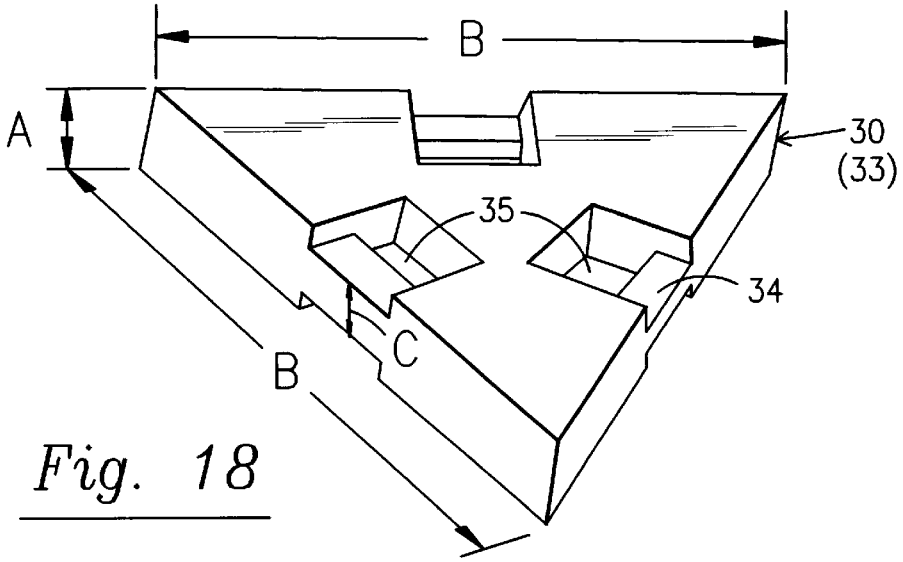
FIG. 18 is a perspective view showing one example of a regular triangular plane block in Embodiment 2.
Figure 19:
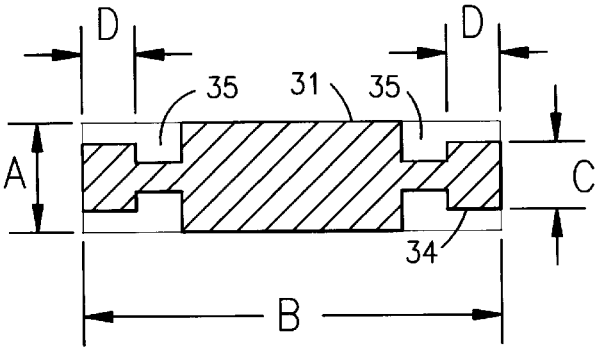
FIG. 19 is a sectional view taken along line of FIG. 17 in Embodiment 2.

FIG. 17 through FIG. 19 show plane block 30 used in Embodiment 2; FIG. 20 through FIG. 24 show joint block 32 used in Embodiment 2; FIG. 25 shows plane block 30 and joint block 32 coupled together in Embodiment 2.

FIG. 26 shows an explanatory view of alternative Embodiment 2.

FIG. 27 through FIG. 30 show plane block 40 used in Embodiment 3; FIG. 31 through FIG. 35 show joint block 42 used in Embodiment 3; FIG. 36 shows plane block 40 and joint block 42 coupled together in Embodiment 3.

FIG. 37 shows an explanatory view of alternative Embodiment 3.

FIG. 38 through FIG. 44 show finished block assemblies according to the present invention; FIG. 45 shows how to prepare a decoration by the block assemblies.

Figure 1:
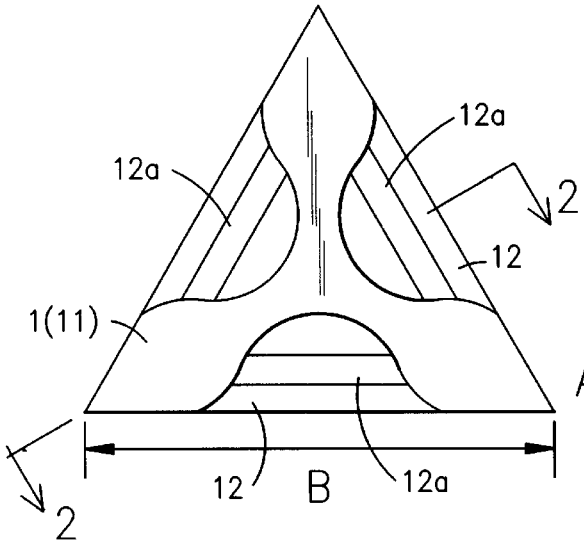
FIG. 1 is a plane view showing one example of a regular triangular plane block in Embodiment 1.
Figure 2:
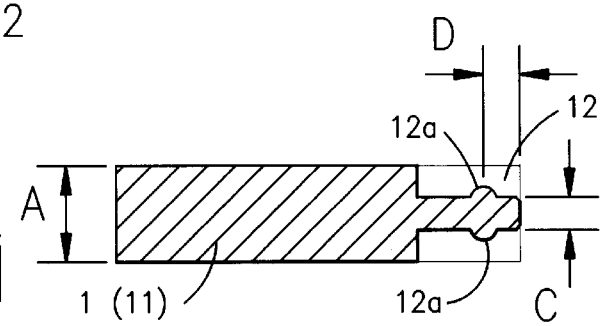
FIG. 2 is a sectional view taken along line of FIG. 1 in Embodiment 1.
Figure 4:
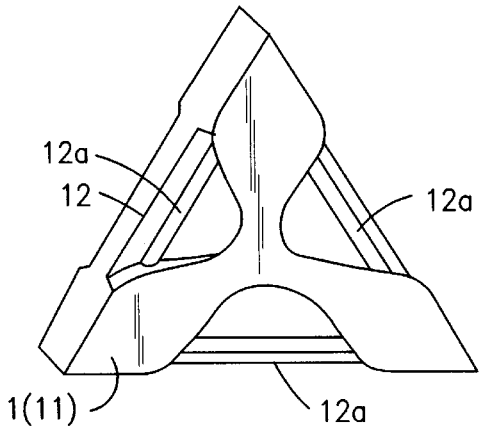
FIG. 4 is a perspective view showing one example of a regular triangular plane block in Embodiment 1.
Figure 5:
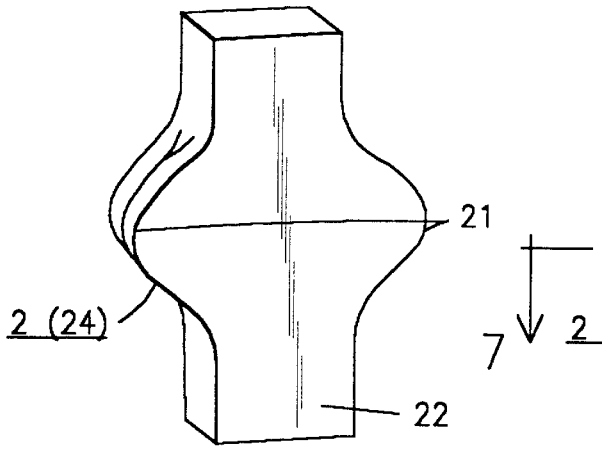
FIG. 5 is a perspective view showing one example of a joint block in Embodiment 1.
Figure 6:
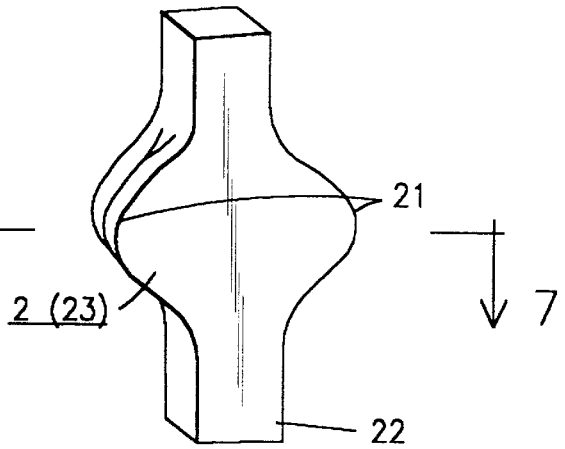
FIG. 6 is a perspective view showing one example of a joint block in Embodiment 1.
Figure 7:
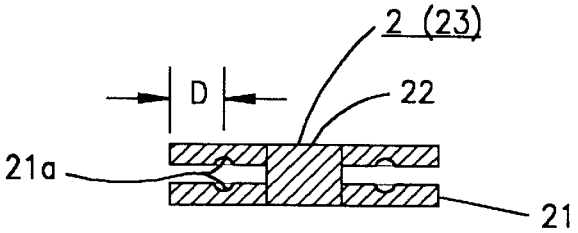
FIG. 7 is a sectional view taken along line 7—7 in FIG. 6 in Embodiment 1.
Figure 8:
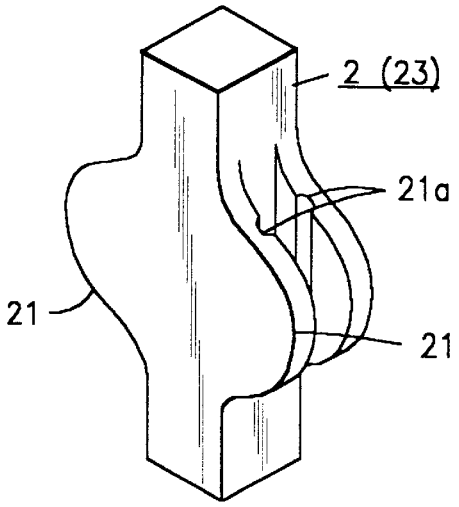
FIG. 8 is a perspective view of FIG. 6 in Embodiment 1.
Figure 9:
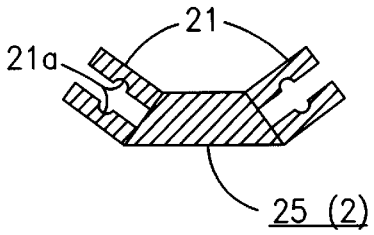
FIG. 9 is a sectional view taken along line of FIG. 10 in Embodiment 1.
Figure 10:
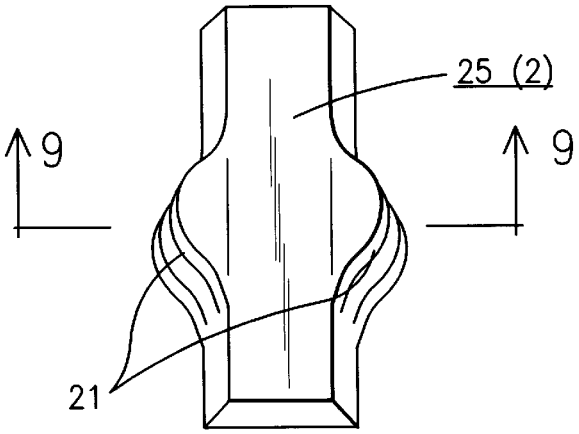
FIG. 10 is a perspective view showing one example of a joint block in Embodiment 1.
Figure 11:
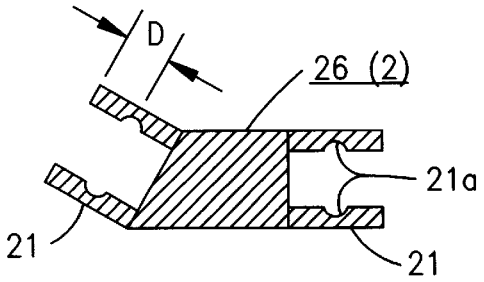
FIG. 11 is a sectional view taken along line of FIG. 12 in Embodiment 1.
Figure 12:
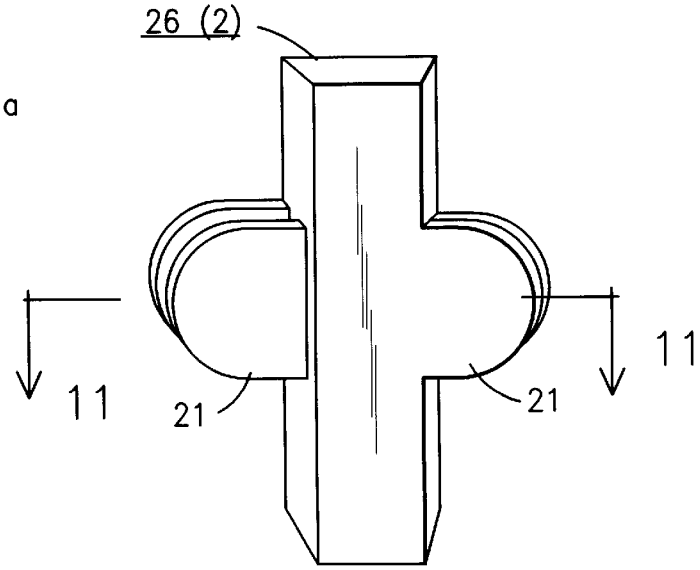
FIG. 12 is a perspective view showing one example of a joint block in Embodiment 1.
Figure 13:
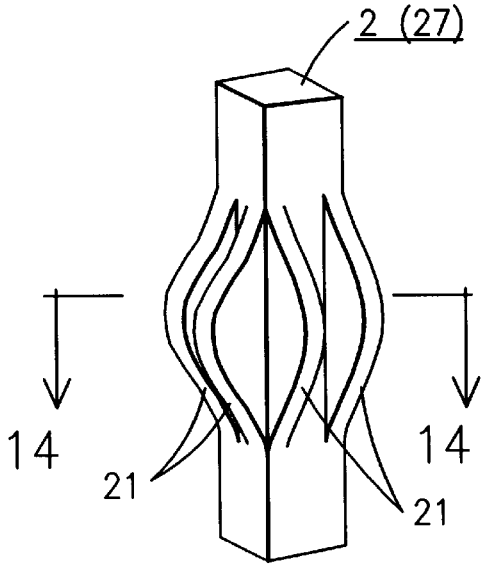
FIG. 13 is a perspective view showing one example of a joint block in Embodiment 1.
Figure 13A:
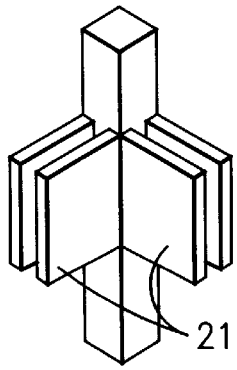
Figure 14:
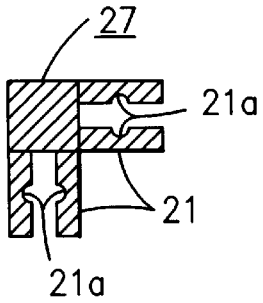
FIG. 14 is a sectional view taken along line of FIG. 13 in Embodiment 1.

Plane block 1 shown in FIG. 1, FIG. 2 or FIG. 4 is regular triangular plane block 11 having coupling recesses 12.

Figure 3:
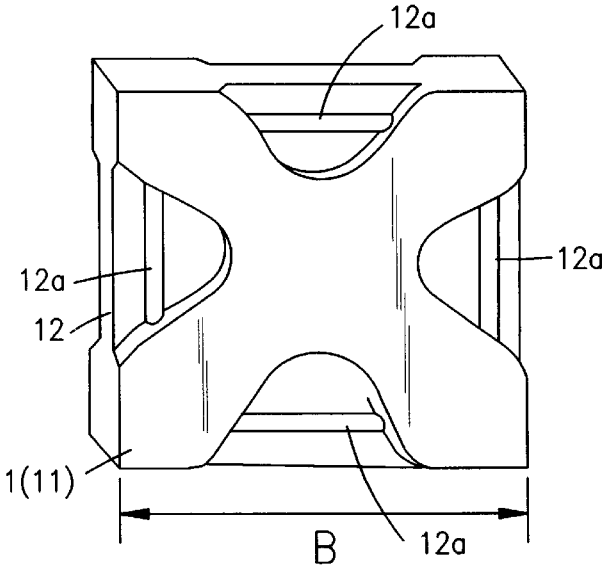
FIG. 3 is a perspective view showing one example of a square plane block in Embodiment 1.

Regular triangular plane block 11 shown in FIG. 1 and square plane block 13 shown in FIG. 3 have a uniform thickness A, and each regular polygonal plane shape of plane block 11 and 13 has a specified side length B.

The shown embodiment shows a regular triangle and a square as a plane shape of plane block 1, however, any regular polygon such as a regular pentagon, a regular hexagon or a regular octagon may be adopted for another embodiment of the present invention.

Coupling recess 12 of plane block 1 is notched toward the center of regular polygon in the center of each side of regular polygon with a uniform thickness C and with a specified same shape, in the embodiment, with a helmet shape as a plane shape.

Coupling recess 12 of plane block 1 may be any plane shape such as a spindle, a rectangle, a bell, or a pentagon, in fine, any shape with a same size and a same shape with these of coupling protrusion 21 of joint block 2 stated below.

FIG. 5 through FIG. 15 show joint block 2.

Joint block 2 shaped as a prism with a uniform thickness A may have a height B corresponding to a side length of plane block, or may have a height shorter than B, and has coupling protrusions 21 with a specified same shape corresponding to that of coupling recess 12, a helmet shape in a plane shape in the shown embodiment, in the center of each longer side of two or three opposite or adjacent side faces, coupling protrusion 21 comprising a pair of pinch members spaced each other by a distance C and projecting outwardly.

Joint block 2 may be a joint block with side faces shaped as square 23 (shown in FIG. 6, FIG. 7 and FIG. 8), rectangle 24 (shown in FIG. 5), isoceles trapezoid 25 (shown in FIG. 9 and FIG. 10) or right scalene trapezoid 26 (FIG. 11 and FIG. 12) which is provided with coupling protrusion 21 at each shorter side (a,c) of two opposite side faces.

Joint block 2 may be a joint block with side faces shaped as square 27 (shown in FIG. 13 and FIG. 14) which is provided with coupling protrusion 21 in each of adjacent two side faces, or a joint block with side faces shaped as square 28 (shown in FIG. 15) which is provided with coupling protrusion 21 on each of three side faces.

Coupling recess 12 has fitting rib 12*a* on each top and bottom surface thereof in parallel with an outer side of regular polygon spaced by a distance D.

Coupling protrusion 21 has fitting groove 21*a* on each inner surface of the pinch members in parallel with a longer side of a prism spaced by a distance D.

Figure 38:
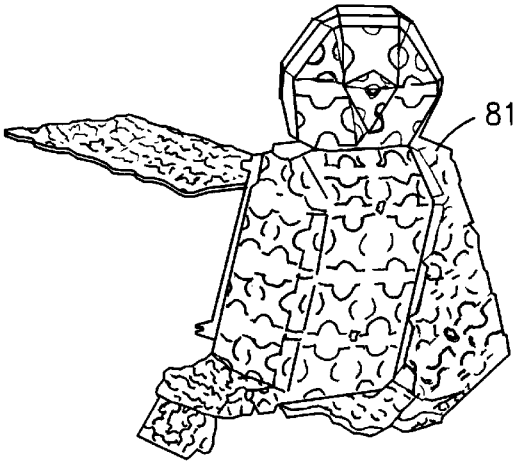
FIG. 38 is a perspective view showing a finished block assembly of a penguin.
Figure 39:
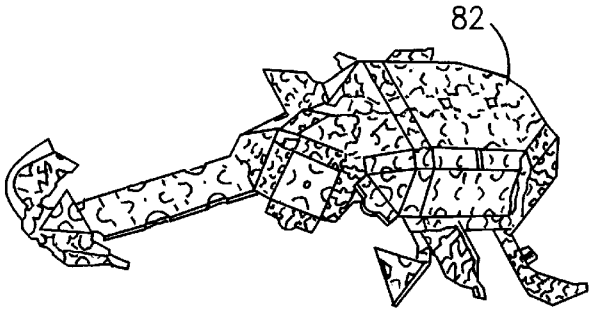
FIG. 39 is a perspective view showing a finished block assembly of a beetle.
Figure 40:
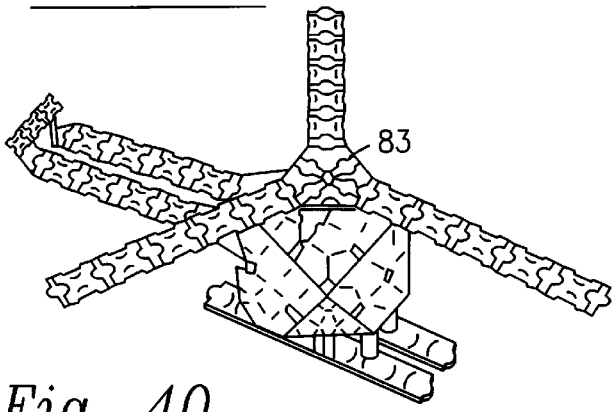
FIG. 40 is a perspective view showing a finished block assembly of a helicopter.
Figure 41:
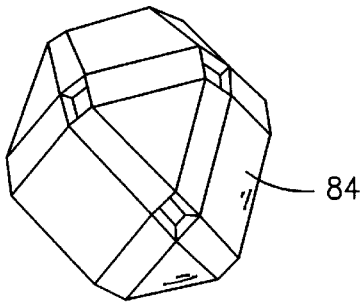
FIG. 41 is a perspective view showing a finished block assembly of a small sphere.
Figure 42:
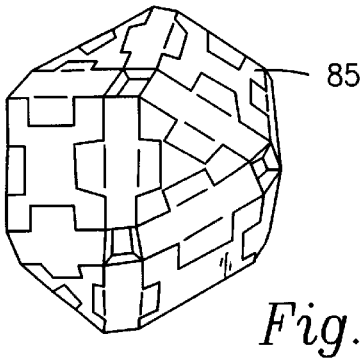
FIG. 42 is a perspective view showing a finished block assembly of a big sphere.
Figure 43:
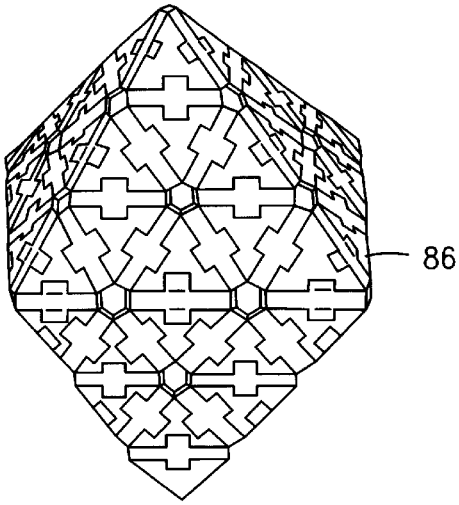
FIG. 43 is a perspective view showing a finished block assembly of a box.
Figure 44:
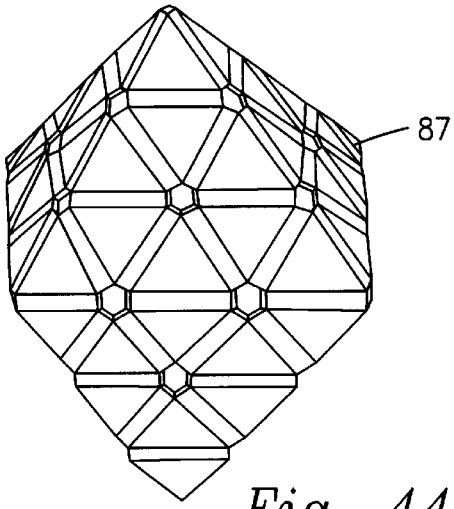
FIG. 44 is a perspective view showing a finished block assembly of a box.

In assembling of penguin 81 shown in FIG. 38, beetle 82 shown in FIG. 39, helicopter 83 shown in FIG. 40, or solid bodies 84, 85, 86, 87 shown in FIG. 41 through FIG. 44, fitting rib 12*a* and fitting groove 21*a* are engaged each other with a click or a snap so that users can realize that blocks have been coupled.

FIG. 16 shows an explanatory view of alternative Embodiment 1.

In this alternative Embodiment 1, structure and figure are almost the same as these of the above Embodiment 1 except the thickness of joint block 2.

It is possible to select more thick or more thin thickness than plane block 1's thickness A as thickness T of joint block 2, but it is neccesary to adjust center line L of each plane block 1 with center line l of each joint block 2 at the same position.

Hereafter further embodiment of Embodiment 1 (not shown) will be described.

The present invention can favorably adopt the another embodiment that coupling recesses of a plane block respectively is formed as a groove which is hollowed toward the center of regular polygon with a uniform thickness C and with a specified same shape in spite of providing coupling recess 12 in the center of each side of regular polygon of plane block 1, and coupling protrusions of a joint block formed as a tongue, in spite of the shape of coupling protrusion 21 of joint block 2 described above, with a same shape corresponding to that of the coupling recess and with a thickness C respectively is provided in the center of each longer side of two or three opposite or adjacent side faces of prism and projects outwardly.

In this embodiment, a fitting groove is provided on each top and bottom face of the coupling recess in parallel with an outer side of regular polygon spaced by a distance D, and a fitting rib is provided on each surface of the coupling protrusion in parallel with a longer side of a prism spaced by a distance D.

Embodiment 2 will be described below.

Plane block 30 shown in FIG. 17 is square plane block 31 with a specified thickness A and with a uniform side length B, having coupling grooves 34 with a uniform thickness C.

Regular triangle plane block 33 shown in FIG. 18 has a uniform thickness A and a specified side length B, and coupling groove 34 has a uniform thickness C.

The shown embodiment shows a regular triangle and a square as a plane shape of plane block 30, however, any regular polygon such as a regular pentagon, a regular hexagon or a regular octagon may be adopted for another embodiment in the present invention.

Coupling groove 34 of plane block 30 is notched toward the center of regular polygon in the center of each side of a polygon with a uniform thickness C and with a specified same shape, in the embodiment, with a square shape as a plane shape.

Fitting groove 35 is provided in the interior portion of coupling groove 34 spaced by a distance D from an outer side of regular polygon.

Coupling groove 34 of plane block 30 may have a plane shape such as a spindle, a rectangle, a bell, or a pentagon, in fine, any shape with a same size and a same shape with these of coupling pinch portion 37 of joint block 32 stated below.

FIG. 20 through FIG. 24 show joint block 32.

Joint block 32 shaped as a prism with a uniform thickness A may have a height B corresponding to a side length of plane block, or may have a height shorter than B, and has coupling pinch portions 37 with a specified shape for engaging with coupling grooves 34 in the center of each longer side of two or three opposite or adjacent side faces.

In the shown embodiment, coupling pinch portion 37 with a square shape as a plane shape comprises a pair of pinch members spaced each other by a distance C and projecting outwardly.

At the tip of coupling portion 37 are provided fitting bulges 39 facing inwardly which engage fitting grooves 35 to ensure the coupling of coupling groove 35 of plane block 30 and coupling pinch portion 37 of joint block 37.

Figure 20:
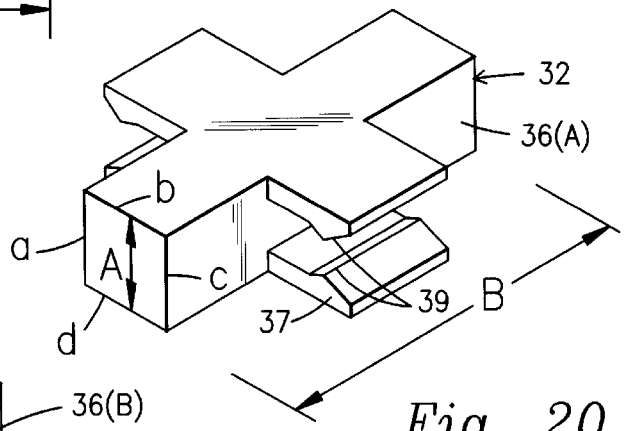
FIG. 20 is a perspective view showing one example of a joint block in Embodiment 2.

Joint block 36(A) shown in FIG. 20 is a joint block with square side faces which is provided with coupling pinch portion 37 at each shorter side (a,c) of two opposite side faces.

Figure 21:
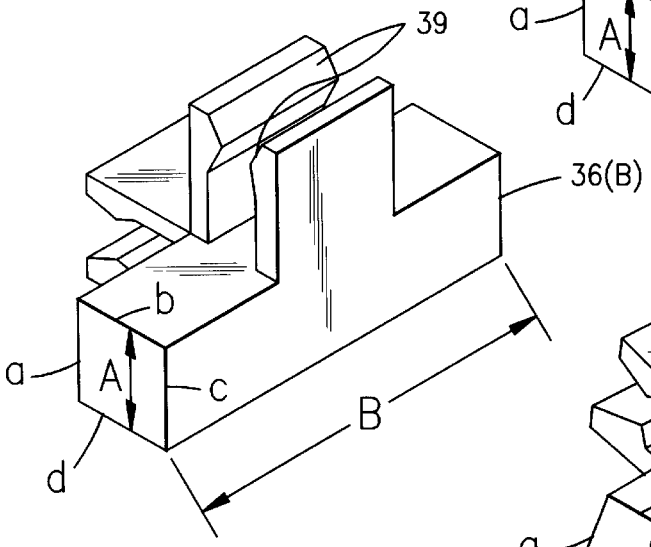
FIG. 21 is a perspective view showing one example of a joint block in Embodiment 2.

Joint block 36(B) shown in FIG. 21 is a joint block with square side faces which is provided with coupling pinch portion 37 at each shorter side (a,b) of two adjacent side faces.

Figure 22:
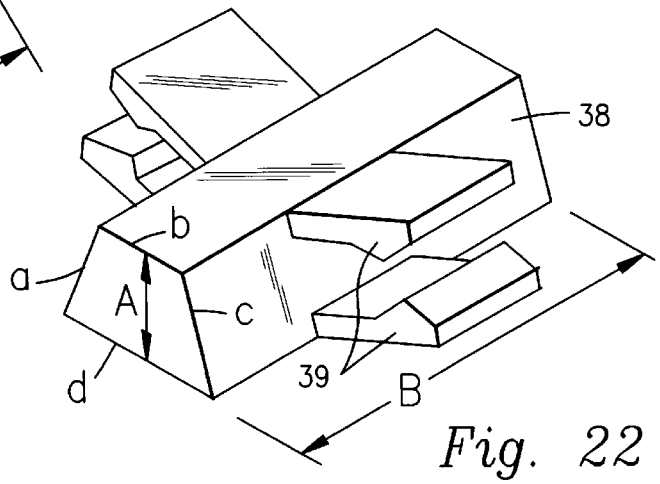
FIG. 22 is a perspective view showing one example of a joint block in Embodiment 2.

Joint block 38 shown in FIG. 22 is a joint block with isoceles trapezoidal side faces which is provided with coupling pinch portion 37 at each shorter side (a,c) of two opposite side faces.

Figure 23:
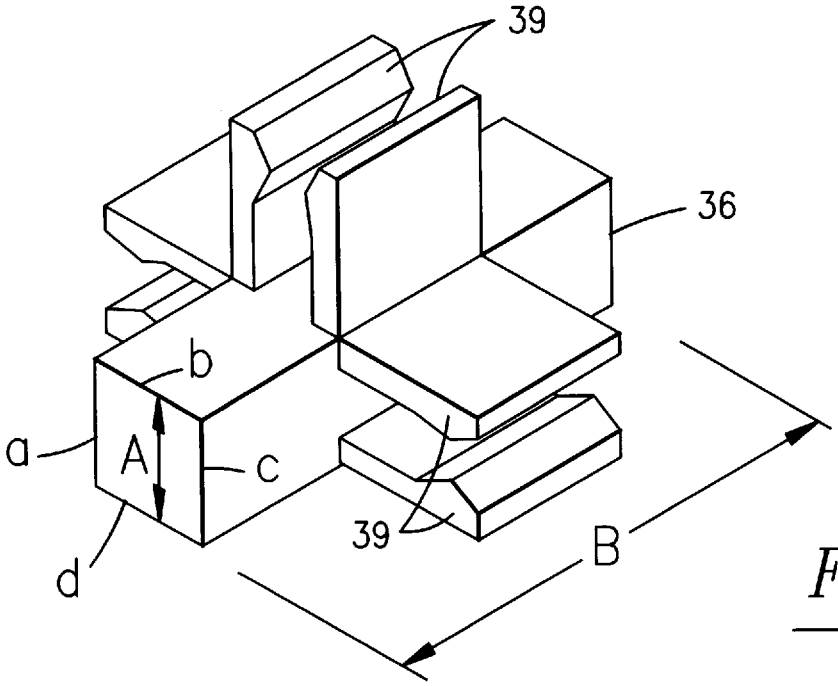
FIG. 23 is a perspective view showing one example of a joint block in Embodiment 2.

Joint block 36(C) shown in FIG. 23 is a joint block with square side faces which is provided with coupling pinch portion 37 at each shorter side (a,b,c) of three side faces.

Figure 24:
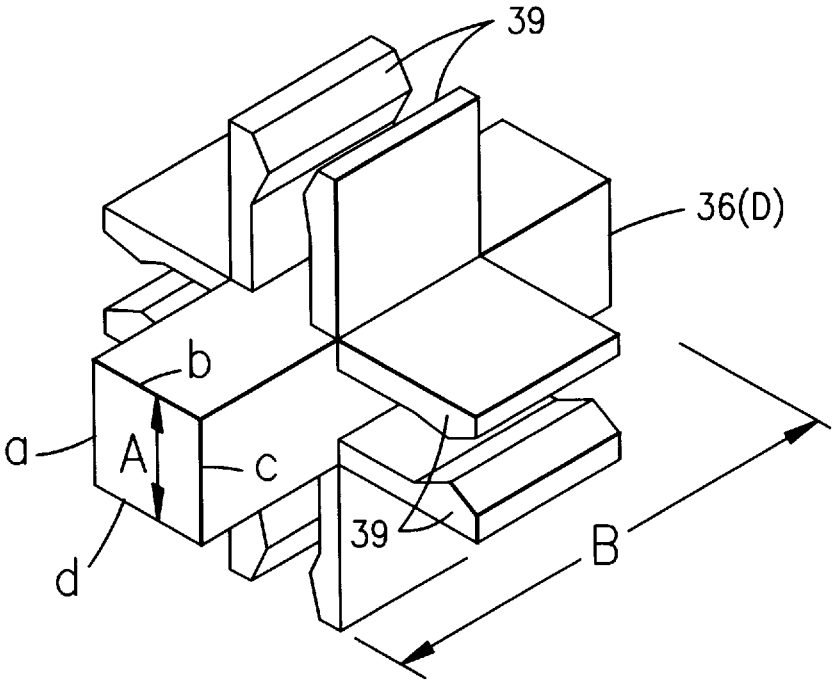
FIG. 24 is a perspective view showing one example of a joint block in Embodiment 2.

Joint block 36(D) shown in FIG. 24 is a joint block with square side faces which is provided with coupling pinch portion 37 at each shorter side (a,b,c,d) of four side faces.

By coupling of coupling pinch portion 37 and coupling groove 34 as shown in FIG. 25, plane block 30 and joint block 32 is assembled successively into penguin 81 shown in FIG. 38, beetle 82 shown in FIG. 39, helicopter 83 shown in FIG. 40, or solid bodies 84, 85, 86, 87 shown in FIG. 41 through FIG. 44 with a click or a snap so that users can realize that blocks have been coupled.

FIG. 26 shows an explanatory view of alternative Embodiment 2.

In this alternative Embodiment 2, structure and figure are almost the same as these of the above Embodiment 2 except the thickness of joint block 31.

It is possible to select more thick or more thin thickness than plane block 31's thickness A as thickness T of joint block 32, but it is neccesary to adjust center line L of each plane block 31 with center line l of each joint block 32 at the same position.

Embodiment 3 will be described below.

Figure 27:
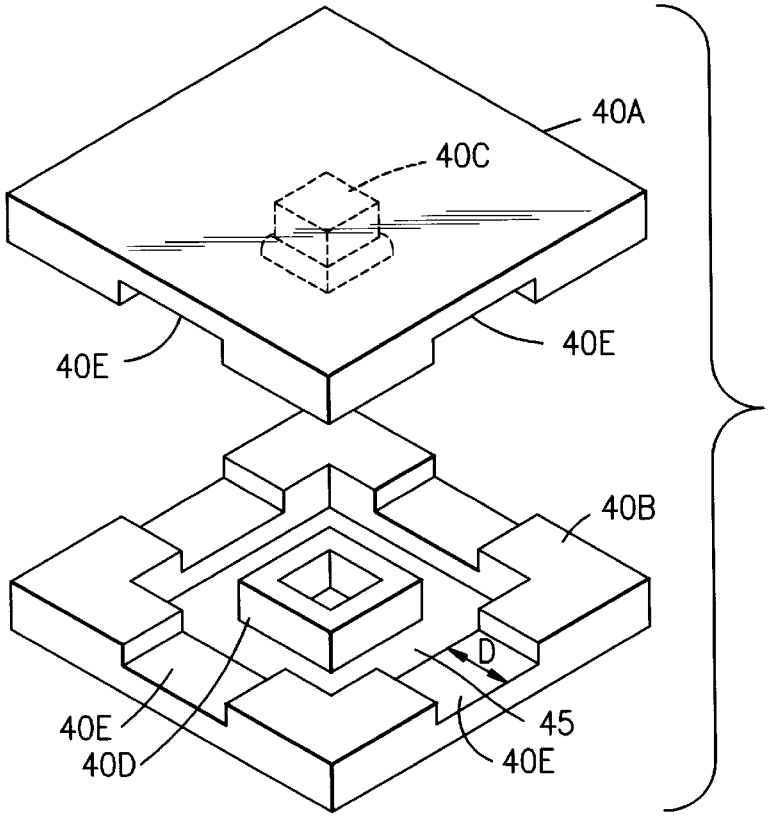
FIG. 27 is an assembly drawing showing one example of a square plane block in Embodiment 3.
Figure 28:
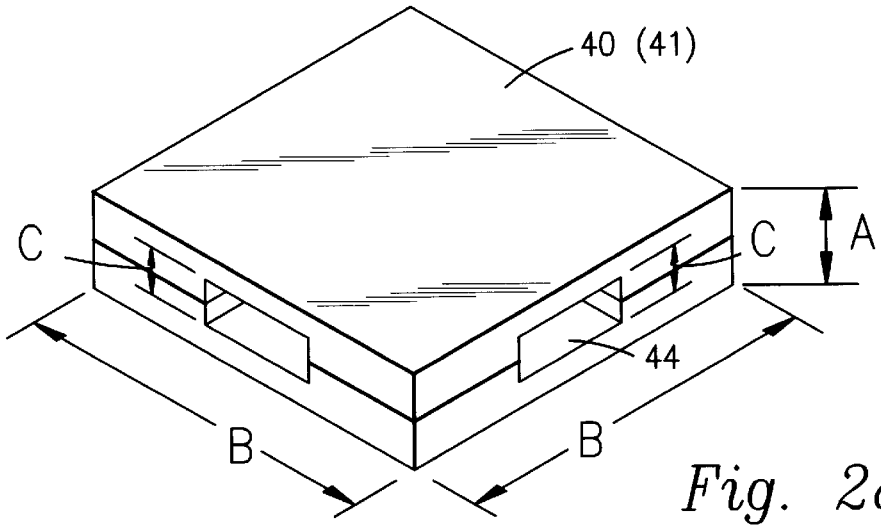
FIG. 28 is a perspective view showing one example of a square plane block in Embodiment 3.

Plane block 40 shown in FIG. 27 and FIG. 28 is square plane block 41 with a uniform thickness A and with a specified side length B having coupling sockets 44 with a thickness C.

Figure 29:
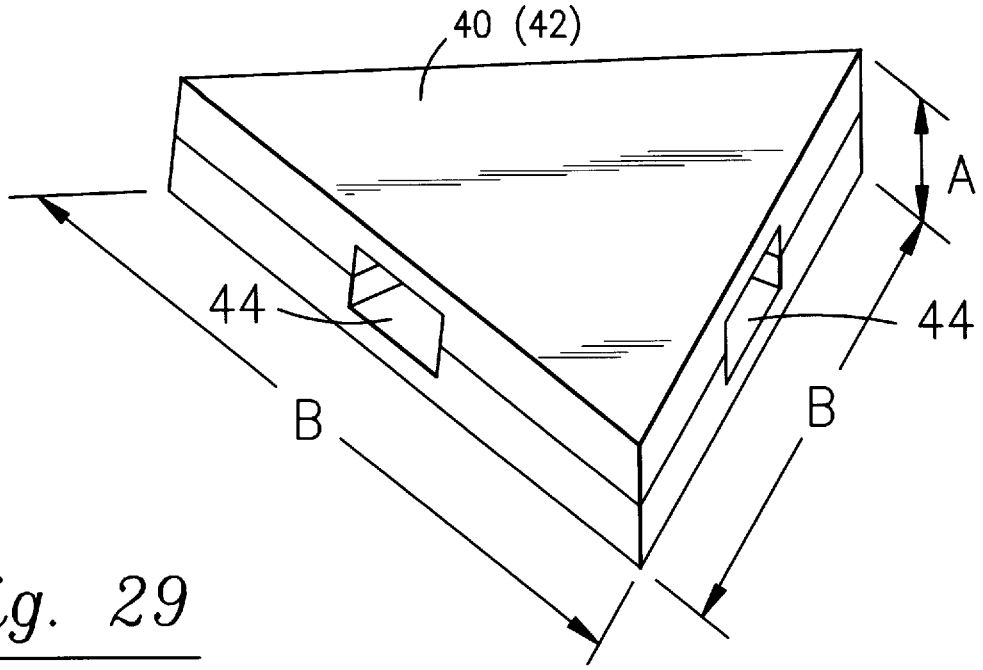
FIG. 29 is a perspective view showing one example of a regular triangular plane block in Embodiment 3.
Figure 30:
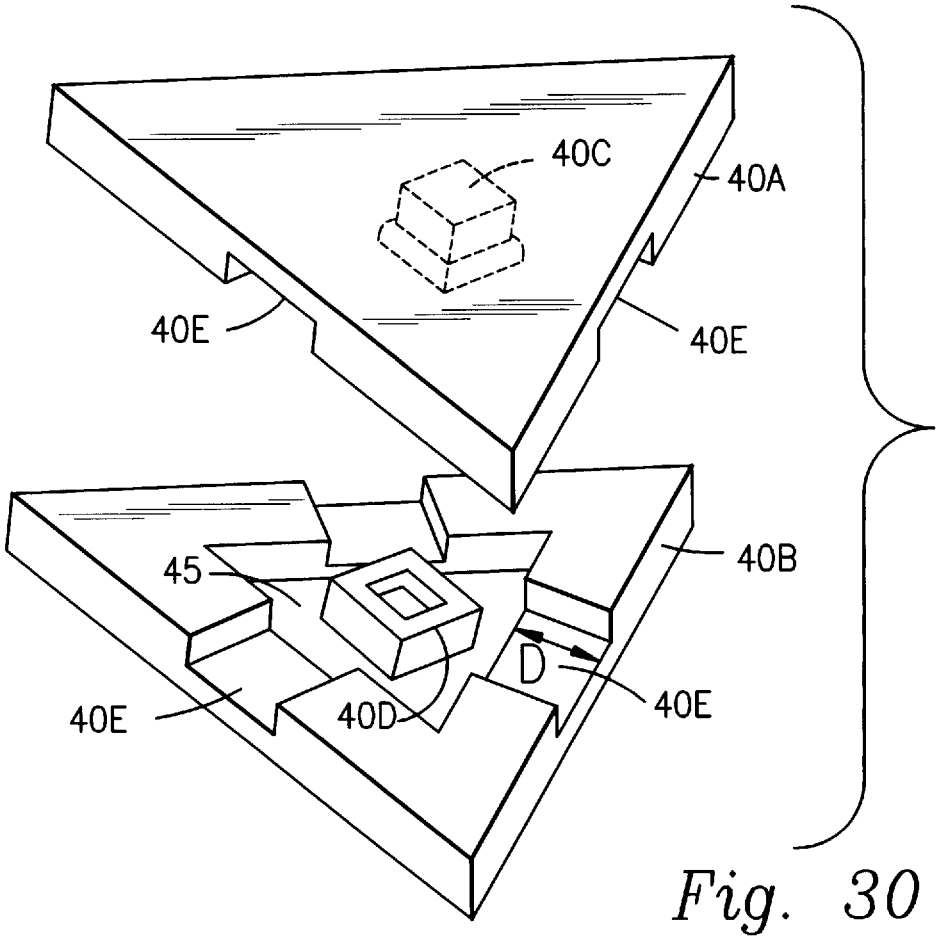
FIG. 30 is an assembly drawing showing one example of a regular triangular plane block in Embodiment 3.

Regular triangle plane block 42 shown in FIG. 29 and FIG. 30 has a uniform thickness A and a specified side length B, and coupling socket 44 has a thickness C.

The shown embodiment shows a regular triangle and a square as a plane shape of plane block 40, however, any regular polygon such as a regular pentagon, a regular hexagon or a regular octagon may be adopted for another embodiment in the present invention.

Coupling sockets 44 of plane block 40 are composed of upper plate 40A and lower plate 40B.

In the center of upper plate 40A is formed fitting portion 40C, in the center of a recess of lower plate 40B is formed concave portion 40D, and in the center of each side of upper plate 40A and lower plate 40B is formed notch portion 40E. Upper plate 40A and lower plate 40B are put together to form plane block 40 so that opposite notch portions 40E are put together to form coupling sockets 44.

Alternatively, concave portion 40D may be formed at upper plate 40A, then fitting portion 40C is formed at lower plate.

Fitting groove 45 is provided in the interior portion of coupling socket 44 spaced by distance D from an outer side of regular polygon.

Coupling socket 44 of plane block 40 may be any plane shape such as a spindle, a rectangle, a bell, a pentagon and so on, in fine, any shape with a same size and a same shape with these of coupling plug 46 of joint block 42 stated below.

FIG. 31 through FIG. 35 show joint block 42.

Joint block 42 shaped as a prism with a uniform thickness A may have a height B corresponding to a side length of plane block, or may have a height shorter than B, and have coupling plug 46 with a specified same shape engaging with coupling socket 44 in the center of each longer side of two or three opposite or adjacent side faces.

In the shown embodiment, coupling plug 46 with a thickness C projects outwardly.

At the tip of coupling plug 46 is provided fitting bulge 47 which engages fitting groove 45 to ensure the coupling of coupling socket 44 of plane block 40 and coupling plug 46 of joint block 42.

Figure 31:
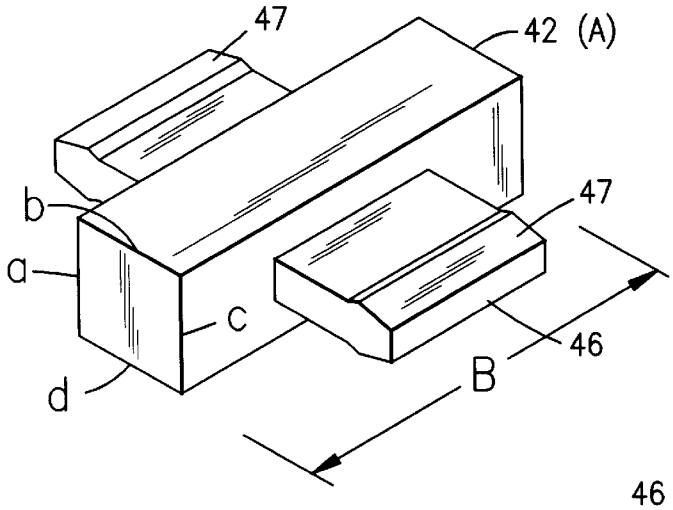
FIG. 31 is a perspective view showing one example of a joint block in Embodiment 3.

Joint block 42(A) shown in FIG. 31 is a joint block with square side faces which is provided with coupling plug 46 at each shorter side (a,c) of two opposite side faces.

Figure 32:
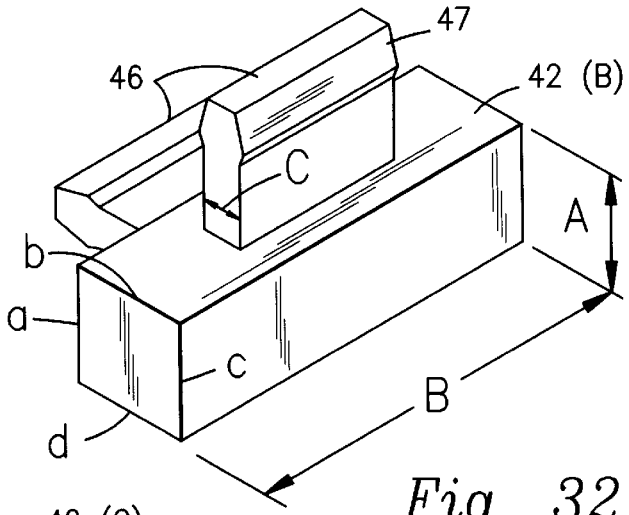
FIG. 32 is a perspective view showing one example of a joint block in Embodiment 3.

Joint block 42(B) shown in FIG. 32 is a joint block with square side faces which is provided with coupling plug 46 at each shorter side (a,b) of two adjacent side faces.

Figure 33:
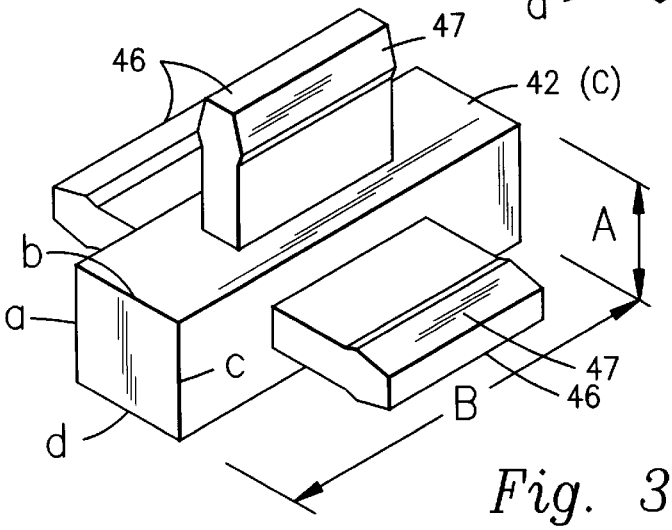
FIG. 33 is a perspective view showing one example of a joint block in Embodiment 3.

Joint block 42(C) shown in FIG. 33 is a joint block with square side faces which is provided with coupling plug 46 at each shorter side (a,b,c) of three side faces.

Figure 34:
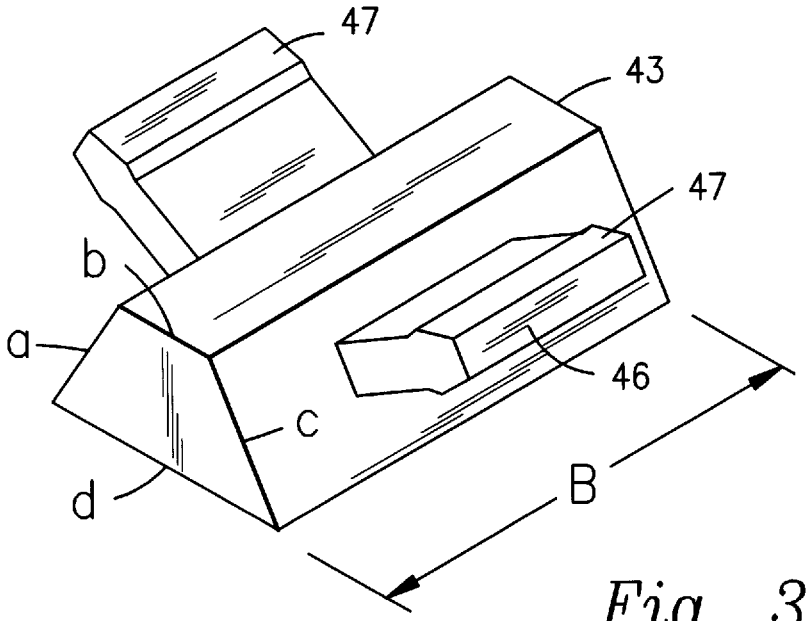
FIG. 34 is a perspective view showing one example of a joint block in Embodiment 3.

Joint block 43 shown in FIG. 34 is a joint block with isoceles trapezoidal side faces which is provided with coupling plug 46 at each shorter side (a,c) of two opposite side faces.

Figure 35:
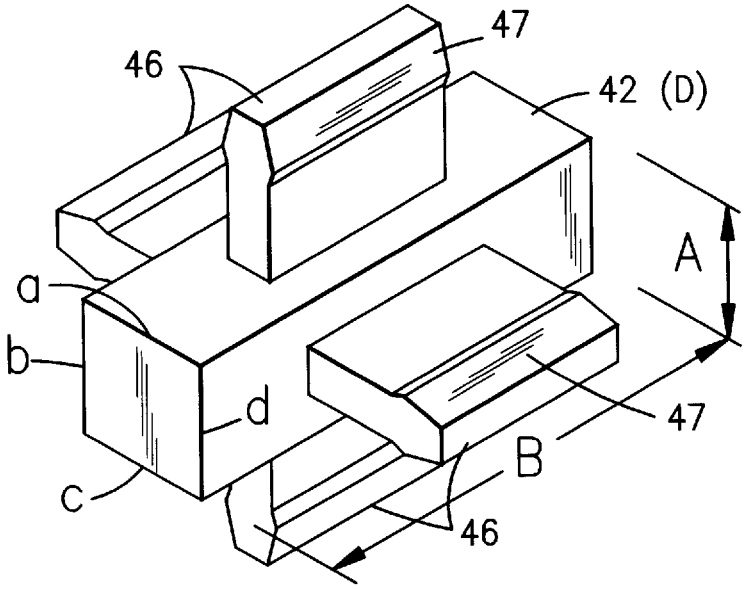
FIG. 35 is a perspective view showing one example of a joint block in Embodiment 3.

Joint block 42(D) shown in FIG. 35 is a joint block with square side faces which is provided with coupling plug 46 at each shorter side (a,b,c,d) of four side faces.

By coupling of coupling plug 46 and coupling socket 44 as shown in FIG. 36, plane block 40 and joint block 42 is assembled successively into penguin 81 shown in FIG. 38, beetle 82 shown in FIG. 39, helicopter 83 shown in FIG. 40, or solid bodies 84, 85, 86, 87 shown in FIG. 41 through FIG. 44 with a click or a snap so that users can realize that blocks have been coupled.

FIG. 37 shows an explanatory view of alternative Embodiment 3.

In this alternative Embodiment 3, structure and figure are almost the same as these of the above Embodiment 3 except the thickness of joint block 42.

It is possible to select more thick or more thin thickness than plane block 40's thickness A as thickness T of joint block 42, but it is neccesary to adjust center line L of each plane block 40 with center line l of each joint block 42 at the same position.

In the present invention, thermal plastic resin, thermosetting resin, wood, ceramic, metal and so on can be generally used as a material for a block assembly.

Chandelier, ornament, furniture, etc. can be made of a block assembly if the block assembly is moulded out of at least one synthetic resin chosen from acrylic resin, styrene resin or ABS resin.

As shown in FIG. 45, block assemblies are assembled into any shape such as a plane body or a solid body, then the prepared block assembly 50 is impregnated with solvent 55 of methyl ethyl ketone or toluene in bath 56 with lid 54 for the necessary time, for from a few seconds to over ten seconds as usual, at an ordinary temperature, or with heating if necessary.

Then block assembly 50 is dried at an ordinary temperature, or with heating if necessary, for an integral solidification to prepare a decoration which can not be decomposed.

It will thus be seen that the objects set forth above, and those made apparent from the foregoing description, are efficiently attained and since certain changes may be made in the foregoing construction without departing from the scope of the intention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been disclosed,

What is claimed is:

1. A construction toy set assembly, comprising:

a plurality of plane blocks, each of the plane blocks having;

an upper plate (40A) and a lower plate (40B), each of the upper and lower plates being of a same geometric polygonal shape having an uniform thickness, and each polygonal plane shape having uniform sides of a predetermined length, each of the uniform sides having a center;

a concave portion (40D) centrally disposed on a first plate of the upper and lower plates and adapted for reciprocative coupling;

a fitting portion (40C) centrally disposed on a second plate of the upper and lower plates and adapted for reciprocative coupling;

a notch portion (40E) located in the center of each side of the first and second plates of the upper and lower plates, the notch portion having a uniform shape and a uniform depth less than the uniform thickness of each of the first and second plates of the upper and lower plates;

a fitting groove (45) located between each of the centrally disposed concave and fitting portions and each of the notch portions of each of the first and second plates of the upper and lower plates;

each plane block being formed when each concave portion and each fitting portion are coupled to one another, the plane blocks each having a uniform thickness and sides of a uniform length;

a coupling socket (44) formed in each of the uniform sides of each of the plane blocks by each of the notch portions located in the center of each side of each of the first and second plates of the upper and lower plates, each of the coupling sockets having a same uniform shape and a same uniform height;

a plurality of joint blocks, each of the joint blocks being of a preselected geometric shape with an uniform thickness and having four side surfaces;

a plurality of coupling plugs (46) extending outwardly from at least one of the joint block side surfaces, each coupling plug having a same predetermined length and a same uniform thickness, each of the coupling plugs having a uniform cross-sectional shape corresponding to the uniform shape of each of the coupling sockets of each of the plane blocks and each coupling plug having a distal end; and a fitting bulge (47) located on the distal end of each of the coupling plugs, the fitting bulge of each of the joint blocks engaging the fitting groove of each of the plane blocks when the coupling socket of each of the plane blocks is coupled with the coupling plug of each of the joint blocks.

2. The construction toy set assembly of claim 1, wherein the plane blocks are each square in shape.

3. The construction toy set assembly of claim 1, wherein the joint blocks are each a rectangular prism in shape.

4. The construction toy set assembly of claim 1, wherein the plane blocks are each triangular in shape.

5. The construction toy set assembly of claim 1, wherein the joint blocks are each in the shape of an isosceles trapezoid prism.

6. The construction toy set assembly of claim 1, wherein each of the four side surfaces of each of the joint blocks are each rectangular in shape and have the coupling plug on each of two side surfaces, the two side surfaces being opposite each other.

7. The construction toy set assembly of claim 1, wherein each of the four side surfaces of each of the joint blocks are each rectangular in shape and have the coupling plug on each of three side surfaces.

8. The construction toy set assembly of claim 1, wherein each of the four side surfaces of each of the joint blocks are each rectangular in shape and have the coupling plug on each of the four side surfaces.

9. The construction toy set assembly of claim 2, wherein each of the four side surfaces of each of the joint blocks are each rectangular in shape and have the coupling plug on each of two side surfaces, the two side surfaces being opposite each other.

10. The construction toy set assembly of claim 2, wherein each of the four side surfaces of each of the joint blocks are each rectangular in shape and have the coupling plug on each of three side surfaces.

11. The construction toy set assembly of claim 2, wherein each of the four side surfaces of each of the joint blocks are each rectangular in shape and have the coupling plug on each of the four side surfaces.

12. The construction toy set assembly of claim 3, wherein each of the four side surfaces of each of the joint blocks are each rectangular in shape and have the coupling plug on each of two side surfaces, the two side surfaces being opposite each other.

13. The construction toy set assembly of claim 3, wherein each of the four side surfaces of each of the joint blocks are each rectangular in shape and have the coupling plug on each of three side surfaces.

14. The construction toy set assembly of claim 3, wherein each of the four side surfaces of each of the joint blocks are each rectangular in shape and have the coupling plug on each of the four side surfaces.

15. The construction toy set assembly of claim 4, wherein each of the four side surfaces of each of the joint blocks are each rectangular in shape and have the coupling plug on each of two side surfaces, the two side surfaces being opposite each other.

16. The construction toy set assembly of claim 4, wherein each of the four side surfaces of each of the joint blocks are each rectangular in shape and have the coupling plug on each of three side surfaces.

17. The construction toy set assembly of claim 4, wherein each of the four side surfaces of each of the joint blocks are each rectangular in shape and have the coupling plug on each of the four side surfaces.

18. The construction toy set assembly of claim 5, wherein each of the four side surfaces of each of the joint blocks are each rectangular in shape and have the coupling plug on each of two side surfaces, the two side surfaces being opposite each other.

19. The construction toy set assembly of claim 5, wherein each of the four side surfaces of each of the joint blocks are each rectangular in shape and have the coupling plug on each of three side surfaces.

20. The construction toy set assembly of claim 5, wherein each of the four side surfaces of each of the joint blocks are each rectangular in shape and have the coupling plug on each of the four side surfaces.

21. The construction toy set assembly of claim 1, wherein the block assembly is made from at least one synthetic resin selected from a group of resins including an acrylic resin, a styrene resin and an ABS resin.

* * * * *